US007192337B2

(12) United States Patent
Shuto

(10) Patent No.: US 7,192,337 B2
(45) Date of Patent: Mar. 20, 2007

(54) METHOD FOR CUTTING DIAMOND

(75) Inventor: Naotake Shuto, Miyagi (JP)

(73) Assignee: Diana Sun Diamond Co., Ltd., Miyagi (JP)

( * ) Notice: Subject to any disclaimer, the term of this patent is extended or adjusted under 35 U.S.C. 154(b) by 0 days.

(21) Appl. No.: 11/354,122

(22) Filed: Feb. 15, 2006

(65) Prior Publication Data

US 2006/0124119 A1 Jun. 15, 2006

Related U.S. Application Data

(62) Division of application No. 10/894,128, filed on Jul. 20, 2004.

(51) Int. Cl.
*B24B 1/00* (2006.01)
*B28D 5/00* (2006.01)

(52) U.S. Cl. ..... 451/41; 125/30.01

(58) Field of Classification Search ..... 125/30.01; 451/41

See application file for complete search history.

(56) References Cited

U.S. PATENT DOCUMENTS

| | | | | |
|---|---|---|---|---|
| 3,534,510 | A * | 10/1970 | Leibowitz | 451/41 |
| 6,397,832 | B1 * | 6/2002 | Shuto | 125/30.01 |
| 6,615,611 | B1 * | 9/2003 | Schachter et al. | 63/32 |
| 2002/0088450 | A1 * | 7/2002 | Shuto | 125/30.01 |

FOREIGN PATENT DOCUMENTS

| | | |
|---|---|---|
| JP | 2000-005993 | 1/2000 |
| JP | 3078636 | 4/2001 |

* cited by examiner

*Primary Examiner*—M. Rachuba
(74) *Attorney, Agent, or Firm*—Wenderoth, Lind & Ponack, L.L.P.

(57) ABSTRACT

To provide a diamond rendering reflective light off a table goldenly brilliant by making a proportion thereof symmetrical at any place viewed from an upper face, a side face or a bottom face, a first reference line, a second reference line crossing the first reference lines at a right angle and third reference lines equally dividing segments defined by an intersection of the first reference line and the second reference line into four equal parts, respectively, are provided. A first arc line intersects these reference lines. An approximately regular hexadecagon shaped table is established by line segments defined between these first intersections of the reference lines with the first arc line. Fourth reference lines dividing sectors defined between the third reference lines into two equal parts and a second arc line concentric with and larger than the first arc line, are provided. Star facets are established by interconnecting intersections of the fourth reference lines and the second arc line with intersections of the first arc line and the first to third reference lines. Upper main facets are established by interconnecting intersections of the first to third reference lines with and an outermost arc line and intersections of the fourth reference lines and the second arc line, and intersections of the fourth reference lines and the second arc line with the first intersections.

16 Claims, 3 Drawing Sheets

METHOD FOR CUTTING DIAMOND

This application is a divisional application of application Ser. No. 10/894,128, filed Jul. 20, 2004.

BACKGROUND OF THE INVENTION

1. Field of the Invention

This invention relates to a method for cutting a diamond, and proportions and brightness of a diamond formed by this cutting method.

2. Related Art

In general, a value of a polished diamond is determined by the 4C's, i.e. Carat (Weight), Clarity (Transparency), Color and Cut. Although these 4C's are important respectively, evaluating of a diamond is generally done by Color, Clarity (Transparency), Cut and Carat (Weight) in the mentioned order.

However, before a diamond cutting method was invented, there had not at all been recognition that a diamond could be a beautiful object. Namely, there had been recognition that a diamond had been a mere hard stone. What caused a diamond which had been recognized before to be a mere hard stone to come to be recognized to be a beautiful thing was development of techniques for brightening the diamond beautifully by cutting the same. Therefore, a diamond cutting method has been considered important.

It can be said that brightness of a diamond can be obtained by cutting the same, and a diamond subjected to an excellent cutting process increases in brightness and glitter. Under these circumstances, stress is laid on a cutting method in a diamond market. Therefore, when beauty of a diamond is taken into consideration, it can also be said that an order of importance for evaluation of the beauty of a diamond is Cut, Color, Clarity (Transparency) and Carat (Weight).

In such a cut evaluation method, proportions, symmetry and a polished condition of a diamond are collectively evaluated, and graduated as a cut grade, which constitutes one of barometers used when a consumer purchases a diamond.

However, a diamond is valuable in itself, so that there is a case where stress is laid more on its dimensions and weight by reducing an area to be cut thereof than on its beauty and glitter shown by cutting the same. This causes proportions of a diamond to be deteriorated in some cases.

Therefore, in recent years, balance of a diamond as a whole has come to be seriously considered, and importance has also been attached to the 4C's+S (Symmetry) in which Symmetry is added to the 4C's mentioned above as important elements for evaluating a diamond.

Thus, since a cut is very important for evaluation of a diamond, techniques for a diamond cutting method has heretofore been studied in various respects. A round brilliant cut and techniques disclosed in JP-A-2000-5993 and JP-U-3078636 have been known. Out of these techniques, the round brilliant cut is famous.

A diamond subjected to a round brilliant cut is a fifty-eight-faced polyhedron, and formed so that rays of light entering the diamond are totally reflected on surfaces of bottom portions thereof and shine beautifully. It is said that this reflected light is dispersed and varies to seven colors.

According to techniques disclosed in JP-A-2000-5993, reference lines are provided a diamond by setting an angle determined by dividing an angle of a circumference of a circle of 360° by a number obtained by multiplying 3 by an integral number thereof. The diamond as a whole is then cut into 65 faces or 86 faces.

According to techniques disclosed in JP-U-3078636, cut surfaces provided on a bottom portion of a pavilion, i.e. cross-shaped cut surfaces are seen from a table surface.

When a diamond is similar to a raw ore thereof, brightness and coloring thereof come to be just as those of a related art diamond, in which there is not variations of an individual diamond. Therefore, new brightness of a diamond has been demanded, and, above all, development of a diamond glittering in a golden color has been expected.

In a diamond cutting method based on techniques for obtaining round brilliant cuts, rays of light entering a diamond are totally reflected from a surface of a bottom portion thereof and glitters beautifully. However, this reflected light is the same as that obtained in a related art diamond cutting method, and this reflected light is unable to express a tone of a gold color.

The invention disclosed in JP-A-2000-5993 is unable to express a tone of a gold color. Since reference lines are provided on a diamond by setting an angle obtained by dividing an angle of a circumference of a circle of 360° by a number obtained by multiplying 3 by an integral number of 3, the diamond is not symmetrical.

The invention disclosed in JP-U-3078636 is not a method of varying a tone of color of a diamond. According to this invention, a cross-shaped cut surface is merely seen from a table surface, and the diamond is not symmetrical.

Therefore, it is an object of the present invention to provide a diamond having excellent proportions, i.e. a diamond substantially symmetrical when the diamond is seen from any positions on upper, side and bottom surfaces thereof with light reflected from a table surface having glitter of a golden color.

SUMMARY OF THE INVENTION

The present invention provides as a first invention thereof, constituting a concrete manner to attain the above object, a method of cutting a diamond having a girdle, a crown formed on an upper side of the girdle and provided with a table at an upper portion thereof, and a pavilion formed on a lower side of the girdle, including steps of providing a first reference line on the diamond; providing on the diamond a second reference line crossing the first reference line at a right angle; providing on the diamond third reference lines dividing a sector between the first and second reference lines into four equal parts; providing on the diamond a first arc-connected line having a diameter equal to that of the table and passing an intersection of these reference lines; connecting first intersections of these reference lines and the first arc-connected line together to define a table of a substantially 16-cornered right polygonal shape; providing on the diamond fourth reference lines dividing sectors between the third reference lines into two equal parts, along with a second arc-connected line concentric with and larger than the first arc-connected line; connecting second intersections of the fourth reference lines and second arc-connected line and the first intersections to define star facets; connecting intersections of an outermost edge (third arc-connected line) of the diamond and the first to third reference lines and the second intersections of the fourth reference lines and second arc-connected line together to define upper main facets as well as paired upper girdle facets between the upper main facets and the outermost edge of the diamond; and cutting the diamond along contours of these respective defined facets.

The diamond may be cut by setting a maximum diameter of the table to substantially 53% of a diameter of the girdle with respect to a base percentage of 100% representing the diameter of the girdle.

Also, the diamond is cut by setting a height of the diamond as a whole, a height of the crown, a height of the pavilion and a maximum width of the girdle to substantially 66.4%, substantially 15.7%, substantially 50% and substantially 1.3%, respectively, with respect to a base percentage of 100% representing the diameter of the girdle.

Further, the diamond may cut by setting an angle to be formed between a reference line of the girdle and crown to substantially 33°.

Furthermore, the diamond is cut by setting an angle to be formed between the reference line of the girdle and pavilion to substantially 42° to 48°.

The present invention provides as a second invention thereof proportions of a diamond having a girdle, a table-carrying crown formed on an upper portion of the girdle, and a pavilion formed on a lower portion of the girdle, with a total height of the diamond, a height of the crown, a height of the pavilion, a maximum width of the girdle and a maximum diameter of the table being set to substantially 66.4%, substantially 15.7%, substantially 50%, substantially 1.3% and substantially 53%, respectively, with respect to a base percentage of 100% representing a diameter of the girdle, to thereby form a table of a substantially 16-cornered right polygonal shape as well as star facets, upper main facets and upper girdle facets, with the pavilion being divided by keel lines opposed to the substantially 16-cornered right polygonal shape of the table, lower girdle facets and lower main facets being formed in each divisional area, and a culet being formed in a central section of a bottom portion.

The diamond may have 65-faced cuts established by the table provided on the crown, star facets, upper main facets and upper girdle facets, and 49-faced cuts established by the lower girdle facets, lower main facets and culet which are formed on the pavilion, for a total of 114-faced cuts being established.

Cuts in all faces except the culet may have substantially symmetrical proportions when the diamond is seen from any of an upper surface, a side surface and a bottom surface thereof.

Further, the diamond may have an angle of substantially 33° formed between the reference line of the girdle and crown.

Furthermore, the diamond may have an angle of substantially 42° to 48° formed between the reference line of the girdle and pavilion.

Owing to such a diamond cutting method or proportions of the resultant diamond formed or set in this manner, a diamond obtained has proportions in which the diamond is substantially symmetrical when the diamond is seen from any of the upper surface, side surface and bottom surface thereof, and is able to have light reflected from the table glitter in a golden color.

DETAILED DESCRIPTION OF PREFERRED EMBODIMENT

Figure 1:
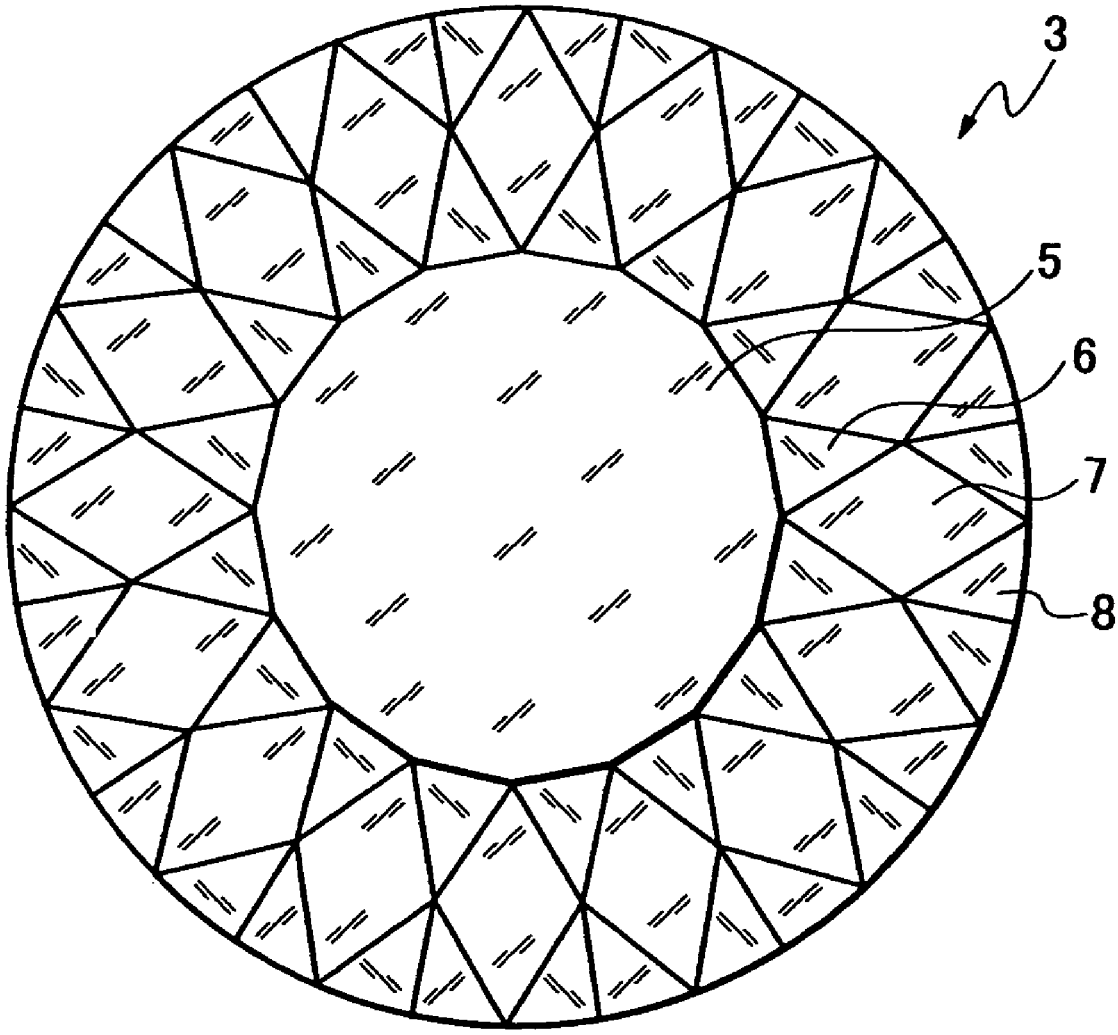
FIG. 1 is a schematic top view of a diamond in an embodiment of the present invention.
Figure 2:
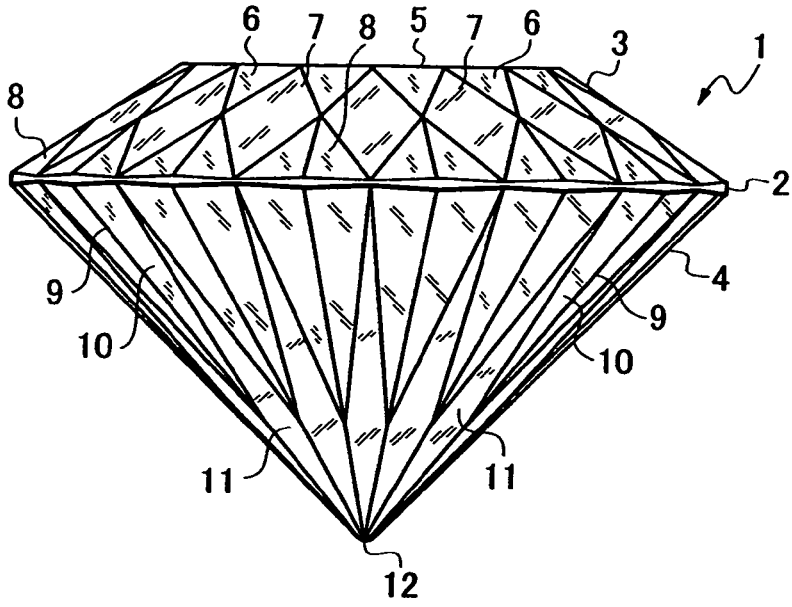
FIG. 2 is a schematic side view of the diamond.
Figure 3:
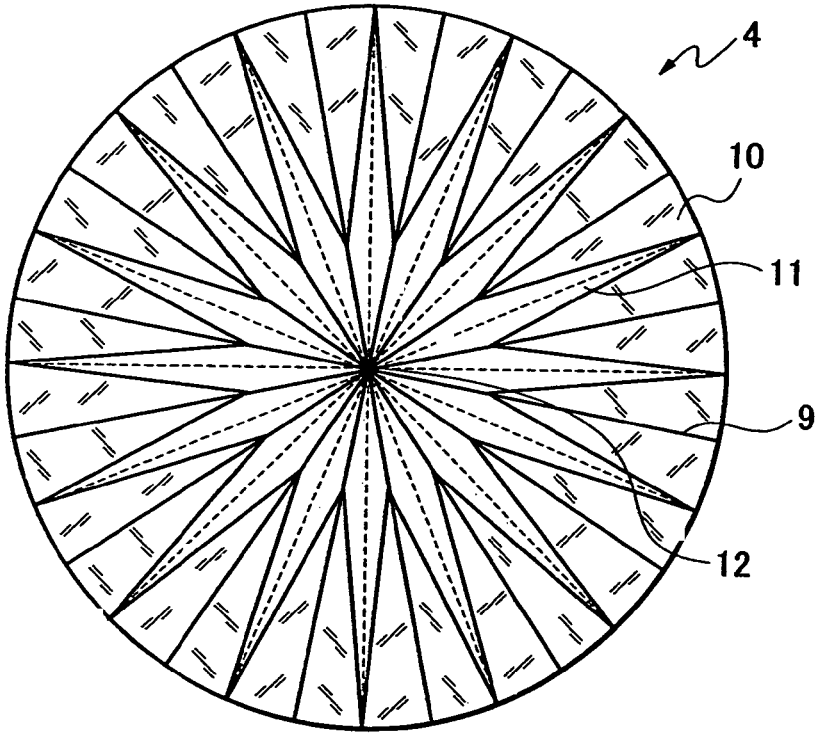
FIG. 3 is a schematic bottom view of the diamond.

A preferred embodiment of the present invention will be described in detail with reference to the accompanying drawings.

FIGS. 1 to 5 show an embodiment of the present invention, and descriptions of the same portions will be given by using the same reference numerals. A cut diamond of proportions 1 includes a girdle 2, a crown 3 formed on an upper portion of the girdle, and a pavilion 4 formed on a lower portion of the girdle. The crown 3 formed on the upper portion of the girdle 2 is provided with a table 5.

The table 5 provided on the crown 3 is formed into a substantially 16-cornered right polygonal shape, and has star facets 6 along sides of the table. Upper main facets 7 are formed so that upper end portions thereof are directed toward a center of the table, with the facets 7 contacting and lying between adjacent star facets 6. Among adjacent upper main facets, paired upper girdle facets 8 are formed.

The pavilion 4 is divided into areas along keel lines 9 opposed to sides of the substantially 16-cornered right polygonal shape of the table 5. In divisional areas, lower girdle facets 10 and lower main facets 11 are formed, and a culet 12 is in a central section of a bottom portion.

Therefore, in the diamond having proportions 1, one face is established by the table 5 provided on the crown 3, and 64 faces by the star facets 6, upper main facets 7 and upper girdle facets 8, i.e., 65 faces on the crown 3. 48 faces are established by the lower girdle facets 10 and lower main facets 11 formed on the pavilion 4, and one face by the culet. Namely, 49 faces are established on the pavilion 4. Accordingly, the diamond as a whole has 114-faced cuts.

Since the crown 3 of the diamond of proportions 1 is formed correspondingly to the table 5 provided on the crown and having a substantially 16-cornered right polygonal shape, the diamond as a whole is balanced well, i.e., substantially symmetrical in a top view, side view and bottom view thereof.

Figure 4:
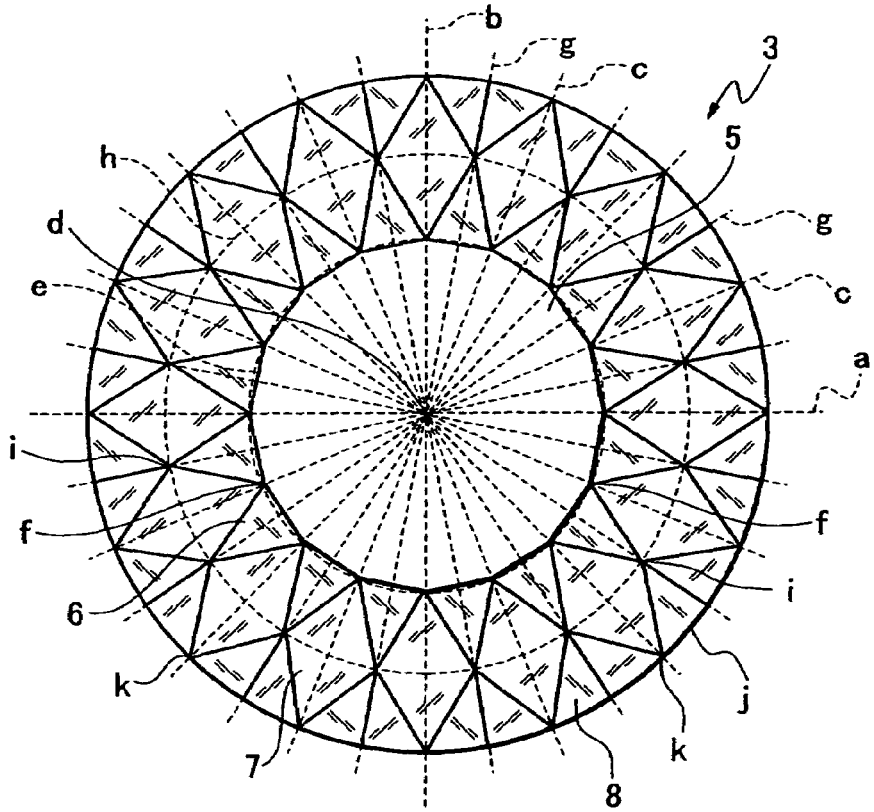
FIG. 4 is an explanatory view of a method of cutting a crown portion of the diamond.

A method of cutting the crown 3 is shown in FIG. 4. In order to cut the table 5 of the crown 3 in a condition shown in FIG. 4, a first reference line a is provided on the diamond, and a second reference line b crossing the first reference line at a right angle is also provided on the diamond, and third reference lines c which divide each sector between the first and second reference lines into four equal parts is provided on the diamond. A first arc-connected line e having a diameter L1 and passing an intersection d of these reference lines is provided, and the table 5 of a substantially 16-cornered right polygonal shape is formed by connecting along line segments defined between intersections f of these reference lines and the first arc-connected line e.

Furthermore, fourth reference lines g dividing sectors between the third reference lines c are provided, along with a second arc-connected line h larger than and concentric with the first arc-connected line e. Line segments defined between intersections of the fourth reference lines g and second arc-connected line h and intersections f, along with the line segments defined between intersections f, cooperate to establish star facets 6. Line segments defined between intersections k of an outermost edge j (third arc-connected line) of the diamond and first reference line a, along with intersections k of the outermost edge j and the second reference line b and third reference lines c, and the intersections i of the fourth reference lines g and second arc-connected line h, and the line segments defined between intersections i and f cooperate to establish upper main facets 7 and paired upper girdle facets 8 between adjacent upper main facets 7 and the outermost edge j of the diamond. When the diamond is cut along contours of these established facets, the crown 3 is formed.

The outermost edge j is shown in phantom, along which the diamond is cut when the girdle 2 is formed. The outermost edge j is cut to form the girdle 2 of a diameter L2. The diameter L1 of the first arc-connected line e is set to substantially 53% with respect to a base percentage of 100% representing the diameter L2 of the girdle 2. As a result, a maximum diameter of the table 5 becomes substantially 53% of that of the girdle 2.

When the crown 3 is thus formed, light entering the table 5 can be reflected more finely, and it becomes possible to have the diamond glitter by reflecting spectra of light of tones, which are different from those of the spectra of light reflected on the table 5, from the star facets 6, upper main facets 7 and upper girdle facets 8.

Figure 5:
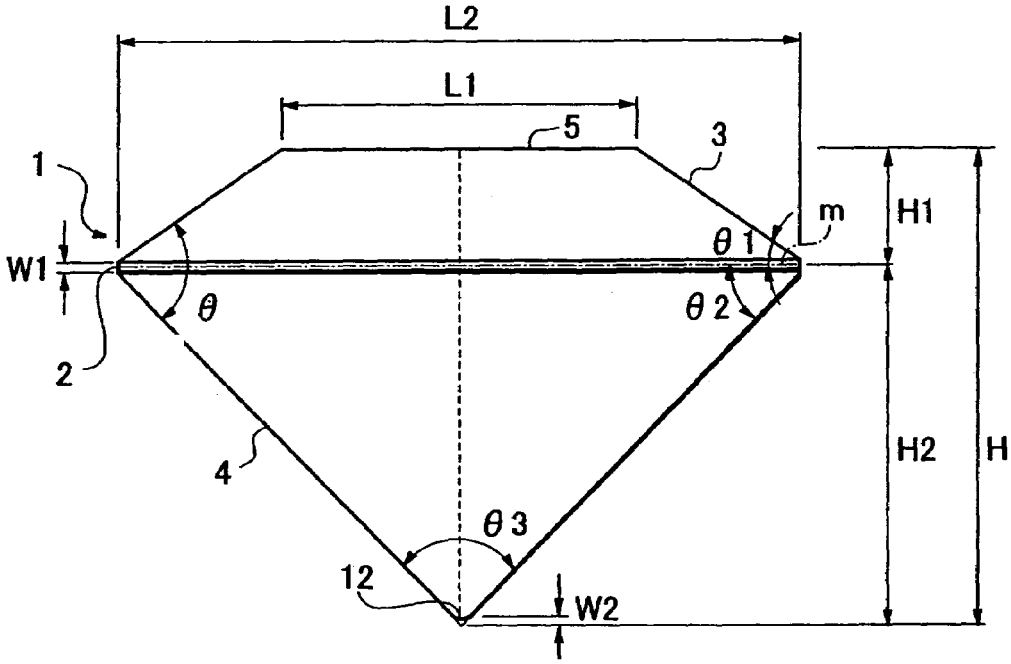
FIG. 5 is a schematic sectional view describing the diamond as a whole.

A construction of each part of the diamond will now be described with reference to FIG. 5 which is a sectional view thereof. The diamond is formed by setting a total height H thereof, height H1 of the crown 3, height H2 of the pavilion 4 and a maximum width W1 of the girdle 2 to 66.4%, 15.7%, substantially 50% and substantially 1.3% respectively with respect to a base percentage of 100% representing the diameter L2 of the girdle 2.

The crown 3 is set to an angle θ1 of substantially 33° with respect to a reference line m of the girdle 2, and the pavilion 4 to an angle of θ2 of substantially 42° to 48° and preferably substantially 45° with respect to the same, so that an angle θ formed between a circumferential surface of the crown 3 and pavilion 4 becomes substantially 75° to 81° and preferably 78°.

Since the total height H of the diamond, the height of the crown H1, the height H2 of the pavilion 4 and the angle θ2 to which the pavilion is set with respect to the reference line m of the girdle 11 are thus set, an angle θ3 of a bottom portion of the pavilion is set to 84° to 96° and preferably substantially 90°.

The lower girdle facets 10 and lower main facets 11 of the pavilion 4 are formed along the keel lines 9 by the same method as that used heretofore. During formation of these facets, the width W2 of the culet 12 is set to 1.6% with respect to a base percentage of 100% representing the diameter L2 of the girdle.

In related art round brilliant cuts, an angle formed between the reference line of the girdle and pavilion is set to substantially 41°, while, in the diamond of proportions 1 according to the present invention, an angle θ2 to which the pavilion 4 is set with respect to the reference line m of the girdle is set to substantially 42° to 48° and preferably to 45°. As a result, the height H2 of the pavilion 4 becomes larger than that of the pavilion of a related art diamond.

When the angle θ2 formed between the pavilion 4 and the reference line m is set to substantially 45°, the table 5 glitters in a golden color, and looks as if a pattern of a multi-petal flower similar to a chrysanthemum floated. The star facets 6, upper main facets 7 and upper girdle facets 8 glitter like aureoles in tones of green, blue or purple.

When the angle θ2 is reduced to smaller than 45°, i.e. substantially 42° to 45°, the table 5 glitters in a tone of a golden color dose to red, and the star facets 6, upper main facets 7 and upper girdle facets 8 glitter like aureoles in tones of green, blue or purple.

When the angle θ2 is increased to larger than 45° i.e. substantially 45° to 48°, the table 5 glitters in a tone of color dose to white. The table 5 glitters in two kinds of tones of colors, i.e. in a golden color at a central portion thereof, and in white at a circumferential portion thereof. The star facets 6, upper main facets 7 and upper girdle facets 8 glitter like aureoles in tones of green, blue and purple.

When light enters the crown 3, the table 5 glitters in golden color since the table 5 reflects a tone of color having a long spectrum. The star facets 6, upper main facets 7 and upper girdle facets 8 glitter like aureoles in tones of green, blue or purple since these facets reflect tones of colors having a short spectrum. These aureoles look as if the aureoles turned when a point of viewing the aureoles is moved.

In the 114-faced cuts of the table 5 in the present invention of a substantially 16-cornered right polygonal shape, light reflected from the crown 3 turns into light on a finer nano-scale as compared with light reflected from a related art 58-faced body of round brilliant cuts and a table of a 12-cornered polygonal shape of 86-faced cuts, so that this reflected light in an atomized state reflects in an eddy condition on the table 5. Therefore, reflection from the table 5 becomes strong, so that the reflected light looks like reflected light of a tone of color stronger and denser than that of incident light.

Owing to an increase in diffusibility of the light in an interior of the pavilion 4, a wave motion only from which particles of the light are excluded out of the wave motion and particles of the light is reflected, it becomes possible to express a color proper to the light.

As described above, the present invention provides a method of cutting a diamond having a girdle, a crown formed on an upper side of the girdle and provided with a table at an upper portion thereof, and a pavilion formed on a lower side of the girdle, including steps of: providing a first reference line on a diamond; providing on the diamond a second reference line crossing the first reference line at a right angle; providing on the diamond third reference lines dividing a sector between the first and second reference lines into four equal parts; providing on the diamond a first arc-connected line having a diameter equal to that of the table and passing an intersection of these reference lines; defining line segments between first intersections of these reference lines and the first arc-connected line to define a table of a substantially 16-cornered right polygonal shape; providing on the diamond fourth reference lines dividing sectors between the third reference lines into two parts, and intersecting these fourth reference lines with a second arc-connected line; connecting line segments defined between second intersections of the fourth reference lines and second arc-connected line with line segments defined between the first intersections to define star facets; connecting line segments defined by intersections of an outermost edge of the diamond and the first to third reference lines and intersections of the fourth reference lines and second arc-connected line with line segments defined between the second intersections and the first intersections to define paired upper main facets as well as upper girdle facets between the upper main facets and the outermost edge of the diamond; and cutting the diamond along contours of these respective defined facets. This makes it possible that the diamond has substantially symmetrical proportions in any of a top view, side view and bottom view thereof, so that balance of the diamond as a whole can be expressed beautifully with the table rendered able to glitter in golden color.

The present invention provides as a second aspect thereof a method of cutting a diamond having a girdle, a table-carrying crown formed on an upper portion of the girdle, and a pavilion formed on a lower portion of the girdle, with a total height of the diamond, the height of the crown, height of the pavilion, a maximum width of the girdle and a maximum diameter of the table being set to substantially 66.4%, substantially 15.7%, substantially 50%, substantially 1.3% and substantially 53%, respectively, with respect to a base percentage of 100% representing a diameter of the girdle, to thereby form a table of a substantially 16-cornered right polygonal shape as well as star facets, upper main facets and upper girdle facets, wherein the pavilion is divided by keel lines opposed to the substantially 16-cornered right polygonal shape of the table, lower girdle facets and lower main facets are formed in each divisional area, and a culet is formed in a central section of a bottom portion. This makes it possible that the diamond has substantially symmetrical proportions in any of top view, side view and bottom view thereof, so that a balance of the diamond as a whole can be expressed beautifully with the table rendered able to glitter in golden color, all of which constitute excellent effects of the present invention.

As described, the diamond cutting method and proportions of a resultant diamond formed or set according to the invention provide superior advantages in that a diamond obtained has proportions in which the diamond is substantially symmetrical when the diamond is seen from any of an upper surface, side surface and bottom surface thereof, so that balance of the diamond as a whole can be expressed beautifully. Additionally, since reflected light in an atomized state reflects in an eddy condition from the table, reflection from the table becomes strong, so that the reflected light looks like reflected light of a tone of color stronger and denser than that of incident light, with the table rendered able to glitter in golden color.

What is claimed is:

1. A method for cutting a diamond having a girdle, a crown formed on an upper side of the girdle and provided with a table at an upper portion thereof, and a pavilion formed on a lower side of the girdle, said method comprising:

defining a first reference line on said table;

defining a second reference line on said table, said second reference line crossing said first reference at a right angle so as to define four sectors;

defining third reference lines on said table, said third reference lines intersecting said first reference line and said second reference line at a central point of said table so as to divide each of said four sectors into four equal sub-sectors;

defining a first arc-connected line on said table, said first arc-connected line having a diameter equal to a diameter of said table and intersecting said first reference line, said second reference line and said third reference lines at first points such that a chord is defined by every two immediately circumferentially adjacent ones of said first points, whereby defined by said chords is a 16-cornered right polygonal shape;

defining a second arc-connected line on said crown, said second arc-connected line having a diameter greater than said diameter of said first arc-connected line and being centrally co-axial with said first arc-connected line;

defining a third arc-connected line that corresponds to an outer circumference of said girdle, said third arc-connected line having a diameter greater than said diameter of said second arc-connected line and being centrally co-axial with said second arc-connected line;

defining fourth reference lines on said crown, said fourth reference lines (i) intersecting said second arc-connected line at second points, (ii) intersecting said third arc-connected line at third points, (iii) intersecting one another at a point that is on a central axis of said first arc-connected line, and (iv) bisecting said chords, respectively;

defining first line segments extending from every two immediately circumferentially adjacent ones of said first points to one of said second points that corresponds to an intersection of said second arc-connected line and a corresponding one of said fourth reference lines that bisects said chord defined by said every two immediately circumferentially adjacent ones of said first points, so as to define a first planar portion by said first line segments and said chord;

defining fifth reference lines on said crown, said fifth reference lines (i) intersecting said second arc-connected line at fourth points, (ii) intersecting said third arc-connected line at fifth points, (iii) intersecting one another at the point that is on the central axis of said first arc-connected line, and (iv) each having thereon one of said first points;

defining second line segments from every two immediately circumferentially adjacent ones of said second points to one of said fifth points that corresponds to an intersection of said third arc-connected line and a corresponding one of said fifth reference lines that passes between said every two immediately circumferentially adjacent ones of said second points, so as to define (i) a second planar portion by said second line segments and a corresponding two adjacent ones of said first line segments that do not define parts of the same first planar portion, (ii) paired third planar portions, with each one of said paired planar third portions being defined by a third line segment extending from one of said third points to an immediately circumferentially adjacent one of said fifth points, a fourth line segment extending from said one of said third points to one of said fourth points that is located on the same fourth reference line, and a corresponding one of said second line segments, wherein said fourth line segment is common to each one of said paired third planar portions; and cutting said diamond along said first planar portions to form star facets, cutting said diamond along said second planar portions to form upper main facets, and cutting said diamond along said paired third planar portions to form paired upper girdle facets.

2. The method according to claim 1, wherein an angle between any of said fourth and fifth reference lines and a plane containing said outer circumference of said girdle is substantially 33°.

3. The method according to claim 2, wherein a total height of said diamond is substantially 66.4% of a diameter of said girdle, a height of said crown is substantially 15.7% of said diameter of said girdle, a height of said pavilion is substantially 50% of said diameter of said girdle, and a maximum width of said girdle is substantially 1.3% of said diameter of said girdle.

4. The method according to claim 3, wherein a sixth reference line extends from a base of said pavilion to an outer circumferential surface of said girdle, with an angle between said sixth reference line and a plane containing said outer circumference of said girdle being substantially within a range of from 42° to 48°.

5. The method according to claim 4, wherein said diameter of said table is substantially 53% of a diameter of said girdle.

6. The method according to claim 1, wherein said diameter of said table is substantially 53% of a diameter of said girdle.

7. The method according to claim 6, wherein an angle between any of said fourth and fifth reference lines and a plane containing said outer circumference of said girdle is substantially 33°.

8. The method according to claim 7, wherein a sixth reference line extends from a base of said pavilion to an outer circumferential surface of said girdle, with an angle between said sixth reference line and said plane containing said outer circumference of said girdle being substantially within a range of from 42° to 48°.

9. The method according to claim 6, wherein a total height of said diamond is substantially 66.4% of said diameter of said girdle, a height of said crown is substantially 15.7% of said diameter of said girdle, a height of said pavilion is substantially 50% of said diameter of said girdle, and a maximum width of said girdle is substantially 1.3% of said diameter of said girdle.

10. The method according to claim 9, wherein an angle between any of said fourth and fifth reference lines and a plane containing said outer circumference of said girdle is substantially 33°.

11. The method according to claim 9, wherein a sixth reference line extends from a base of said pavilion to an outer circumferential surface of said girdle, with an angle between said sixth reference line and a plane containing said outer circumference of said girdle being substantially within a range of from 42° to 48°.

12. The method according to claim 6, wherein a sixth reference line extends from a base of said pavilion to an outer circumferential surface of said girdle, with an angle between said sixth reference line and a plane containing said outer circumference of said girdle being substantially within a range of from 42° to 48°.

13. The method according to claim 1, wherein a sixth reference line extends from a base of said pavilion to an outer circumferential surface of said girdle, with an angle between said sixth reference line and a plane containing said outer circumference of said girdle being substantially within a range of from 42° to 48°.

14. The method according to claim 13, wherein a total height of said diamond is substantially 66.4% of a diameter of said girdle, a height of said crown is substantially 15.7% of said diameter of said girdle, a height of said pavilion is substantially 50% of said diameter of said girdle, and a maximum width of said girdle is substantially 1.3% of said diameter of said girdle.

15. The method according to claim 13, wherein an angle between any of said fourth and fifth reference lines and said plane containing said outer circumference of said girdle is substantially 33°.

16. The method according to claim 1, wherein a total height of said diamond is substantially 66.4% of a diameter of said girdle, a height of said crown is substantially 15.7% of said diameter of said girdle, a height of said pavilion is substantially 50% of said diameter of said girdle, and a maximum width of said girdle is substantially 1.3% of said diameter of said girdle.

* * * * *